US011549674B2

(12) United States Patent
Todaro

(10) Patent No.: US 11,549,674 B2
(45) Date of Patent: Jan. 10, 2023

(54) UNDERWATER LIGHTING APPARATUS

(71) Applicant: Ocean LED Marine Limited, Hinckley (GB)

(72) Inventor: Daniele Todaro, Hinckley (GB)

(73) Assignee: OCEAN LED MARINE LIMITED, Hinckley (GB)

( * ) Notice: Subject to any disclaimer, the term of this patent is extended or adjusted under 35 U.S.C. 154(b) by 0 days.

(21) Appl. No.: 17/204,022

(22) Filed: Mar. 17, 2021

(65) Prior Publication Data

US 2021/0293402 A1 Sep. 23, 2021

(30) Foreign Application Priority Data

Mar. 17, 2020 (GB) ..... 2003843

(51) Int. Cl.
*F21V 23/06* (2006.01)
*F21V 31/00* (2006.01)

(52) U.S. Cl.
CPC ..... *F21V 23/06* (2013.01); *F21V 31/005* (2013.01)

(58) Field of Classification Search
CPC ..... F21V 23/06; F21V 31/005
See application file for complete search history.

(56) References Cited

U.S. PATENT DOCUMENTS

| | | | | |
|---|---|---|---|---|
| 4,963,102 | A * | 10/1990 | Gettig | H01R 24/84 439/291 |
| 6,184,628 | B1 | 2/2001 | Ruthenberg | |
| 9,285,109 | B1 | 3/2016 | Olsson et al. | |
| 2003/0048632 | A1 | 3/2003 | Archer | |
| 2012/0113654 | A1 | 5/2012 | Dai | |
| 2017/0073048 | A1 * | 3/2017 | Butcher | B63B 45/02 |

FOREIGN PATENT DOCUMENTS

| | | |
|---|---|---|
| CN | 2816597 Y | 9/2006 |
| GB | 2398374 A | 8/2004 |

OTHER PUBLICATIONS

UKIPO, Search Report for corresponding UK Patent Application No. GB2003843.6, dated Jul. 15, 2020, 1 page.
EPO, Extended European Search Report for corresponding European Patent Application No. 21163219.5, dated Jun. 11, 2021, 7 pages.

* cited by examiner

*Primary Examiner* — Anabel Ton
(74) *Attorney, Agent, or Firm* — NK Patent Law

(57) ABSTRACT

An underwater lighting apparatus includes a cofferdam having a cofferdam electrical connector rigidly mounted within the cofferdam at an inner end; a lighting unit sized and shaped to be mounted within the cofferdam and having a lighting unit electrical connector rigidly mounted at an inner end; wherein the lighting unit electrical connector is sized and shaped to directly connect with the cofferdam electrical connector to form a rigid connection between the cofferdam and the lighting unit. The lighting apparatus is beneficial in that both the cofferdam electrical connector and the lighting unit electrical connector are rigidly mounted.

13 Claims, 2 Drawing Sheets

UNDERWATER LIGHTING APPARATUS

CROSS-REFERENCE TO RELATED APPLICATION(S)

Figure 1:
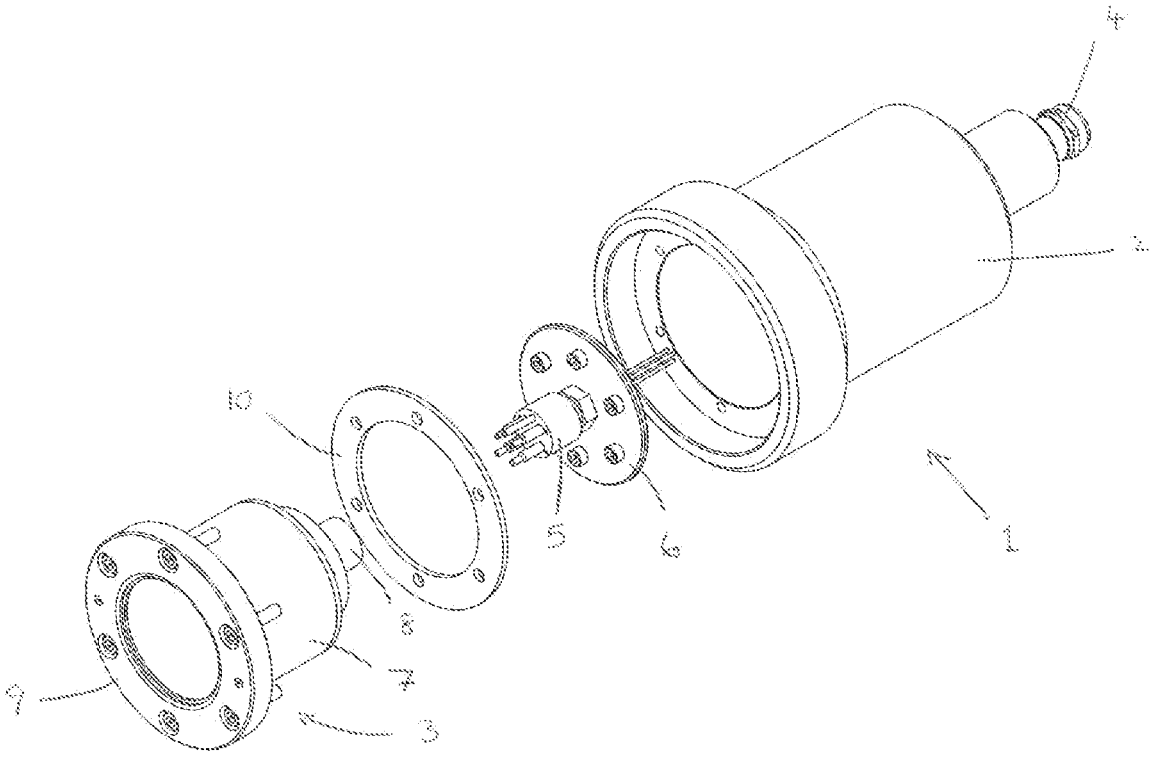

This application claims priority to UK Patent Application No. GB2003843.6 filed on 17 Mar. 2020, entitled "An Underwater Lighting Apparatus," the contents of which are incorporated by reference herein.

FIELD OF THE INVENTION

The present invention relates to underwater lighting. In particular, the present invention relates to underwater lighting units that are mounted in cofferdams, such as those found on the hulls of marine vessels.

BACKGROUND

Many marine vessels, including boats, ships, and yachts, are provided with underwater exterior lighting in their hull. This lighting acts to illuminate the water around the vessel and can provide a pleasing aesthetic appearance. Underwater lighting can also be useful for pleasure fishing vessels. Some underwater lights, particularly smaller lights, are fixed directly to the hull of a marine vessel. However, many larger underwater lights are mounted within cofferdams formed in the hull of the vessel. Cofferdams allow large lights to be securely mounted through the hull of a vessel without the light protruding significantly outwards from the outer surface of the hull, thereby maintaining the hydrodynamics of the hull. Cofferdams also allow lights to be replaced and maintained much more easily than lights that are directly mounted through the hull of a vessel. In particular, individual lights can be removed from a cofferdam whilst the marine vessel remains in water. It is also necessary to mount lights in cofferdams in areas of the hull where access to an internally mounted light would not be possible. For example, at locations on the hull where there is an internal tank (such as fuel/water/ballast etc).

Underwater lighting cofferdams provided in the hull of a marine vessel generally consist of a recessed volume in which a light can be positioned. In some cases, an underwater light will be formed to seal an outer end of the cofferdam when mounted therein. For example, an outer end of a light may comprise a gasket for sealing an outer end of a cofferdam. Alternatively, a cofferdam may completely contain an underwater light and a separate sealing plate and gasket may be provided for sealing the cofferdam.

In prior art embodiments of an underwater lighting system a substantially cylindrical cofferdam is provided in the hull of a marine vessel. An outer end of the cofferdam is open and an inner end of the cofferdam comprises a cable gland through which an electrical cable, for powering and controlling the lighting system, is mounted. An electrical connector is provided at an outer end of the electrical cable for connection with a light. A length of the electrical cable, sufficient to extend out of the cofferdam and above the water line, is provided within the cofferdam. A cooperating light is provided that can be mounted within the cofferdam. The light is generally cylindrical and has a mounting plate and gasket formed at an outer end. The mounting plate is formed to allow the light to be securely mounted to an outer end of the gasket to seal the cofferdam and to securely mount the light within the cofferdam. A rigid connector is provided at an inner end of the light. The rigid connector has a connector that is formed to cooperate with the connector formed at an outer end of the electrical cable such that the light can be connected to the light to supply power and control signals to the light.

In the above embodiment, in order to allow the light to be removed from the cofferdam in a simple and straightforward manner, the electrical cable is provided as a significant length of flexible cable extending from the inner end of cofferdam with a connector mounted at an outer end of the electrical cable. When the light is in position within the cofferdam the electrical cable is coiled within the cofferdam. In order to remove the light from the cofferdam the mounting plate is unbolted from the outer end of the cofferdam and the light is pulled outwards from the cofferdam. This may be done underwater by a suitably trained diver. Whilst the light is removed the electrical cable remains connected to the light. Removing the light from the cofferdam acts to uncoil the electrical cable. The length of the electrical cable must be sufficient to lift the light out of the water before disconnecting the lighting unit from the electrical cable. Once the light has been completely removed from the cofferdam and lifted out of the water the light can then be disconnected from the electrical cable. The light can then be repaired or replaced.

In this embodiment, in order to mount or replace the light within the cofferdam the above process is reversed. First, the outer end of the electrical cable is connected to the light. It is necessary that this connection takes place out of water. Then the electrical cable is required to be coiled within the cofferdam as the light is moved into position within the cofferdam. Finally, the mounting plate of the light is bolted to the outer end of the cofferdam. This process has three significant issues. First, the coiling of the electrical cable within the cofferdam whilst the light is positioned within the cofferdam is difficult. Second the significant length of the electrical cable allows significant rotational freedom when of the light when it is positioned within the cofferdam. This means the person installing the light within the cofferdam is required to control the rotational alignment of the light within the cofferdam and mount the light appropriately. This is particularly important when the light is directional and is required to positioned within the cofferdam in the correct rotational orientation. Finally, it is necessary to provide a relatively large cofferdam in order to allow the electrical cable to be coiled within the cofferdam when the light is in position within the cofferdam.

In light of the above, there is a need for an improved underwater lighting apparatus for marine vessels comprising a cofferdam in which a light can be inserted into and removed from the cofferdam in a more straightforward manner.

SUMMARY OF THE INVENTION

The present invention provides an underwater lighting apparatus comprising:

a cofferdam having a cofferdam electrical connector rigidly mounted within the cofferdam at an inner end;

a lighting unit sized and shaped to be mounted within the cofferdam and having a lighting unit electrical connector rigidly mounted at an inner end; wherein the lighting unit electrical connector is sized and shaped to directly connect with the cofferdam electrical connector to form a rigid connection between the cofferdam and the lighting unit.

The underwater lighting apparatus of the present invention differs from underwater lighting apparatus according to the prior art comprising a lighting unit and a cofferdam in that both the lighting unit has an electrical connector rigidly mounted at an inner end and the cofferdam has an electrical connector rigidly mounted at an inner end. In the most similar prior art underwater lighting apparatus an electrical connector is flexibly mounted to a connector rigidly mounted at an inner end of the lighting unit by means of a length of connecting cable extending from an inner end of the cofferdam. The provision of a rigidly mounted electrical connector at the inner end of the lighting unit and at the inner end of the cofferdam is beneficial as compared to the prior art. The cooperating rigidly mounted electrical connectors allow the lighting unit to be a "plug and play" light. All that is required to connect the lighting unit within the cofferdam and to connect the lighting unit to the cofferdam electrical connector is to slide the lighting unit within the cofferdam such that the rigidly mounted lighting unit electrical connector connects with the cofferdam electrical connector. There is no need to coil wire as this is done. Disconnecting the lighting unit from the cofferdam is similarly simple, all that is required is to slide the lighting unit out of the cofferdam and this will remove the lighting unit electrical connector from the cofferdam electrical connector.

As the underwater lighting apparatus of the present invention does not require a coil of wire within the cofferdam when the lighting unit is mounted therein, it can be more compact than similar underwater lighting apparatus according to the prior art.

As will be readily appreciated, the electrical connectors of the present invention are intended for use in water. In particular, an interior of the cofferdam will be exposed to salt water when the lighting unit is removed from the cofferdam for repair or replacement. As such, it is preferable that the electrical connectors are suitable for use in salt water and are rated appropriately. As will be further appreciated, the electrical connectors should be "wet-mate" type connectors that can be connected and disconnected whilst submerged in water. Many such connectors are commercially available, for example for use in underwater remote vehicles and in the offshore oil and gas industry, and it is considered that the skilled person would be able to select suitable electrical connectors without difficulty.

In embodiments of the invention the lighting unit electrical connector may be a male connector and the cofferdam electrical connector may be a female connector. In alternative embodiments the lighting unit electrical connector may be a female connector and the cofferdam electrical connector may be a male connector In further alternative embodiments both the lighting unit electrical connector and the cofferdam electrical connectors may be hermaphroditic type connectors.

For simplicity of construction and to ensure the cofferdam is sufficiently robust it may be advantageous that the cofferdam electrical connector is centrally located at the inner end within the cofferdam. In alternative embodiments the cofferdam electrical connector may be offset from the centre of the inner end of the cofferdam, this may be advantageous in embodiments where the cofferdam and/or the lighting unit are not rotationally symmetrical.

In order to robustly mount the cofferdam electrical connector at the inner end of the cofferdam the underwater lighting apparatus may further comprise a connector mounting plate mounted at the inner end within the cofferdam and the cofferdam electrical connector may be mounted to the cofferdam by the connector mounting plate. This provides a safe and secure mounting for the cofferdam electrical connector that is rigid and ensures that the cofferdam electrical connector cannot be knocked out of the appropriate orientation, for example by contact with the lighting unit electrical connector if not aligned properly with one another.

In order to seal the inner end of the cofferdam it may be preferable that, if the cofferdam electrical connector is mounted by means of a connector mounting plate, one or more sealing members may be mounted between the connector mounting plate and the cofferdam. In a similar manner it may be advantageous that the connector mounting plate and the cofferdam electrical connector. Suitable sealing members include but are not limited to o-ring seals. Sealing the inner end of the cofferdam in this manner is advantageous as it can provide good waterproofing that may be necessary, for example when the lighting unit is removed from the cofferdam.

Generally, the cofferdam electrical connector and the lighting unit electrical connector will not be rotationally symmetrical and it will be necessary for the cofferdam electrical connector to be correctly rotationally aligned with lighting unit electrical connector in order to be connected together. In some embodiments of the invention both the cofferdam electrical connector and the lighting unit electrical connector will be rotationally symmetrical such that the relative rotational orientation of the electrical connectors is unimportant.

It may be advantageous that a body of the lighting unit is substantially cylindrical and the cofferdam is shaped to conform to the cylindrical body of the lighting unit. A cylindrical or otherwise rotationally symmetrical body of the lighting unit and a conforming cofferdam may be advantageous as it may make the insertion of the lighting unit into, and the removal of the lighting unit from, the cofferdam easier. A rotationally symmetrical lighting unit and conforming cofferdam may be particularly advantageous in embodiments wherein the both the cofferdam electrical connector and the lighting unit electrical connector will be rotationally symmetrical and the rotational alignment of the lighting unit is unimportant.

In embodiments of the invention it may be advantageous that a body of the lighting unit is not rotationally symmetrical and the cofferdam is shaped to conform to the body of the lighting unit such that the lighting unit can only be inserted into the cofferdam in the correct rotational orientation. This may be advantageous as, by ensuring that the lighting unit can only be inserted into the cofferdam in a single rotational orientation, it ensures that the cofferdam electrical connector and the lighting unit electrical connector are in the correct relative rotational alignment to allow their connection with one another, it also ensures that the lighting unit is inserted in the correct rotational orientation if this is necessary.

In order to mount the lighting unit to the cofferdam it may be advantageous that the lighting unit comprises a mounting plate formed at an outer end for mounting the lighting unit to an outer end of the cofferdam. This provides a simple mounting for the lighting unit within the cofferdam and means that an additional closure is not necessary. A mounting plate may be formed in any manner apparent to the person skilled in the art. A mounting plate, for example, may comprise a substantially circular outwardly extending lip formed around an outer end of the lighting unit and may comprise one or more apertures through which the lighting unit may be bolted to the cofferdam.

If the lighting unit comprises a mounting plate at an outer end it may be advantageous that the underwater lighting apparatus further comprises a gasket for mounting between the mounting plate of the lighting unit and the outer end of the cofferdam. Any suitable gasket may be utilised. A gasket may be advantageous as it can provide a robust and reliable seal between the cofferdam and the lighting unit.

Further features and advantages of the present invention will be apparent from the embodiment shown in the Drawings and described below.

DRAWINGS

Figure 2:
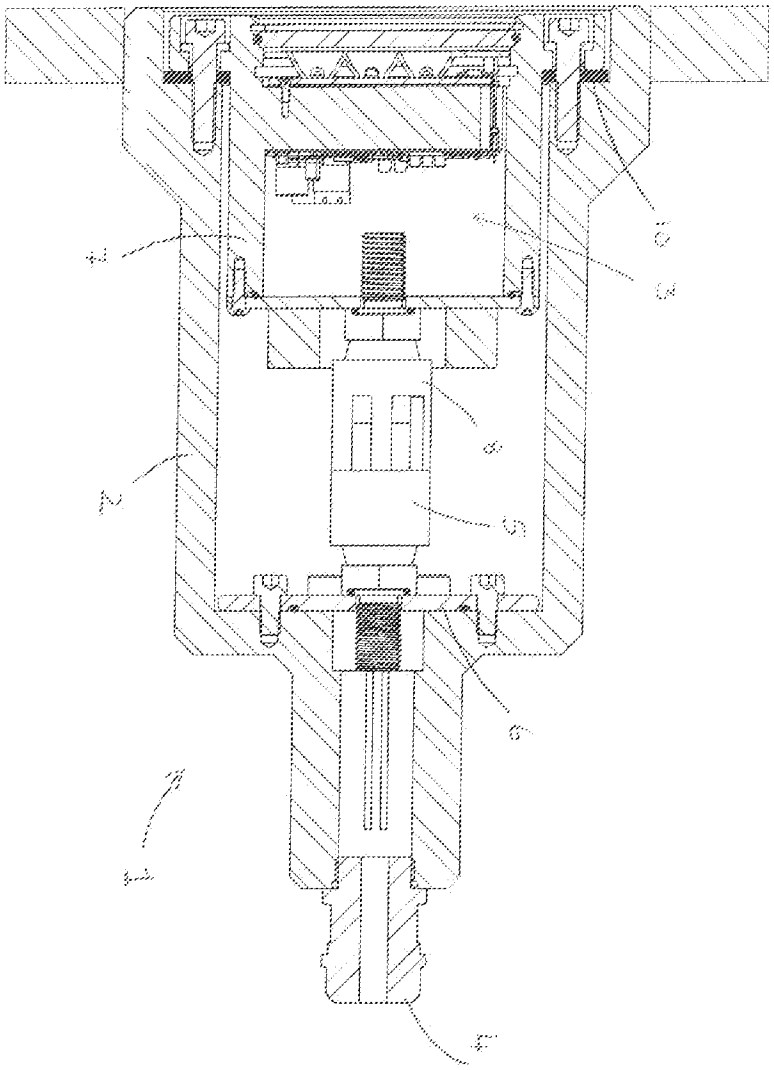

FIG. 1 is an exploded diagram of an embodiment of an underwater lighting apparatus according to the present invention; and FIG. 2 is a cross-section of the underwater lighting apparatus of FIG. 1.

An embodiment of an underwater lighting apparatus 1 according to the present invention is shown in FIGS. 1 and 2. The underwater lighting apparatus 1 comprises a cofferdam 2 and a lighting unit 3. The cofferdam 2 is substantially cylindrical and has a cable gland 4 at an inner end. A power supply cable (not shown) can be positioned through the cable gland 4 to extend from an interior of a marine vessel into the cofferdam 2. The power supply cable has a cofferdam electrical connector 5 mounted at an outer end. The cofferdam electrical connector 5 is centrally fixed to a connector plate 6 and is a male connector. The connector plate 6 is bolted to the cofferdam 4 such that the connector plate 6 and the cofferdam electrical connector are rigidly fixed in position at the inner end of an interior volume of the cofferdam 4.

The lighting unit 3 is rotationally symmetrical and has a cylindrical main body 7. A lighting unit electrical connector 8 is rigidly and centrally mounted to an inner end of the lighting unit 3. The lighting unit electrical connector 8 is a female connector. A circular mounting plate 9 is formed at an outer end of the lighting unit 3 to allow the lighting unit 3 to be mounted within the cofferdam 2. A circular gasket 10 is also provided for mounting between an outer end of the cofferdam 2 and the circular mounting plate 9.

The lighting unit 3 is mounted in the cofferdam 2 in the following manner. First, the lighting unit 3 is correctly rotationally aligned with the cofferdam 2 such that lights of the lighting unit are correctly rotationally oriented and such that the rotational orientation of the lighting unit electrical connector 8 aligns with the rotational orientation of the cofferdam electrical connector 5. The lighting unit 3 is then slid into the cofferdam 2 with the circular gasket 10 positioned between the circular mounting plate 9 of the lighting unit and the cofferdam. The lighting unit 3 is slid into the cofferdam 2 until the lighting unit electrical connector 8 is connected with the cofferdam electrical connector 5. The circular mounting plate 9 of the lighting unit 3 is then bolted to the cofferdam 2 through the circular gasket 10 to hold the lighting unit 3 in place in the cofferdam 2. To remove the lighting unit 3 from the cofferdam 2 this process is reversed.

Due to the rigid mounting of the lighting unit electrical connector 8 and the cofferdam electrical connector 5 the insertion and removal of the lighting unit 3 from the cofferdam is extremely simple. All that is required is the correct rotational alignment of the lighting unit 3 with the cofferdam 2. There is no requirement for coiling of a cable within the cofferdam 2 as there is with comparable prior art underwater lighting apparatus.

The invention claimed is:

1. An underwater lighting apparatus comprising:
- a cofferdam;
- an electrical connector rigidly mounted within the cofferdam at an inner end of the cofferdam;
- a lighting unit sized and shaped to be mounted within the cofferdam and having a lighting unit electrical connector rigidly mounted at an inner end;
- a mounting plate mounted at the inner end within the cofferdam,
- wherein the electrical connector is mounted to the cofferdam on an outer side of the mounting plate,
- wherein the lighting unit electrical connector is sized and shaped to directly connect with the electrical connector of the cofferdam to form a rigid connection between the cofferdam and the lighting unit.

2. An underwater lighting apparatus according to claim 1, wherein the lighting unit electrical connector is a male connector and the electrical connector of the cofferdam is a female connector.

3. An underwater lighting apparatus according to claim 1, wherein the lighting unit electrical connector is a female connector and the electrical connector of the cofferdam is a male connector.

4. An underwater lighting apparatus according to claim 1, wherein the lighting unit electrical connector and the electrical connector of the cofferdam are both hermaphroditic electrical connectors.

5. An underwater lighting apparatus according to claim 1, wherein the electrical connector of the cofferdam is centrally located at the inner end within the cofferdam.

6. An underwater lighting apparatus according to claim 1, further comprising one or more sealing members mounted between the mounting plate and the cofferdam.

7. An underwater lighting apparatus according to claim 1, further comprising one or more sealing members mounted between the electrical connector of the cofferdam and the mounting plate.

8. An underwater lighting apparatus according to claim 6, wherein the one or more sealing members are o-ring seals.

9. An underwater lighting apparatus according to claim 1, wherein a body of the lighting unit is substantially cylindrical and the cofferdam is shaped to conform to the cylindrical body of the lighting unit.

10. An underwater lighting apparatus according to claim 1, wherein a body of the lighting unit is not rotationally symmetrical and the cofferdam is shaped to conform to the body of the lighting unit such that the lighting unit can only be inserted into the cofferdam in the correct rotational orientation.

11. An underwater lighting apparatus according to claim 1, wherein the lighting unit comprises a mounting plate formed at an outer end for mounting the lighting unit to an outer end of the cofferdam.

12. An underwater lighting apparatus according to claim 11, further comprising a gasket for mounting between the mounting plate of the lighting unit and the outer end of the cofferdam.

13. An underwater apparatus according to claim 1, wherein the lighting unit electrical connector and the electrical connecter of the cofferdam are configured for underwater connection and disconnection.

* * * * *